US009223233B2

(12) United States Patent
Tanaka

(10) Patent No.: US 9,223,233 B2
(45) Date of Patent: Dec. 29, 2015

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventor: Masato Tanaka, Tagata-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 32 days.

(21) Appl. No.: 14/089,717

(22) Filed: Nov. 25, 2013

(65) Prior Publication Data

US 2014/0170540 A1 Jun. 19, 2014

(30) Foreign Application Priority Data

Dec. 14, 2012 (JP) ..... 2012-273710

(51) Int. Cl.

| | |
|---|---|
| ***G03G 5/04*** | (2006.01) |
| ***G03G 5/05*** | (2006.01) |
| ***G03G 5/06*** | (2006.01) |

(52) U.S. Cl.

CPC ..... *G03G 5/0542* (2013.01); *G03G 5/0614* (2013.01); *G03G 5/0696* (2013.01)

(58) Field of Classification Search

CPC ... G03G 5/0542; G03G 5/055; G03G 5/0589; G03G 5/0696; G03G 5/051; G03G 5/0521

See application file for complete search history.

(56) References Cited

U.S. PATENT DOCUMENTS

| | | | | |
|---|---|---|---|---|
| 8,088,541 | B2 | 1/2012 | Tanaka et al. | |
| 8,415,078 | B2 | 4/2013 | Tanaka et al. | |
| 8,518,615 | B2 | 8/2013 | Tanaka | |
| 2009/0123176 | A1* | 5/2009 | Tanaka et al. | 399/111 |
| 2012/0003576 | A1* | 1/2012 | Tanaka et al. | 430/56 |
| 2013/0137025 | A1 | 5/2013 | Kawahara et al. | |
| 2013/0137032 | A1 | 5/2013 | Tanaka et al. | |
| 2014/0170541 | A1 | 6/2014 | Tanaka | |

FOREIGN PATENT DOCUMENTS

| | | | |
|---|---|---|---|
| JP | 2004-125907 | A | 4/2004 |
| JP | 2007-182556 | A | 7/2007 |
| JP | 2008-158003 | A | 7/2008 |
| JP | 2011-94101 | A | 5/2011 |
| JP | 2012-32781 | A | 2/2012 |

* cited by examiner

*Primary Examiner* — Peter Vajda

(74) *Attorney, Agent, or Firm* — Fitzpatrick, Cella, Harper and Scinto

(57) ABSTRACT

The photosensitive layer of an electrophotographic photosensitive member contains (a) a gallium phthalocyanine crystal, (b) a specific amine compound and (c) a specific polyvinylacetal resin.

16 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, a process cartridge and an electrophotographic apparatus each having an electrophotographic photosensitive member.

2. Description of the Related Art

Since a semiconductor laser commonly used in an image exposure unit in the field of electrophotography has a long oscillation wavelength in the range of 650 to 820 nm, electrophotographic photosensitive members having high sensitivity to light in the long wavelength range are currently under development.

Phthalocyanine pigments used as a material for electrophotographic photosensitive members are effective as charge generation substances having high sensitivity to the light ranging to such a long wavelength region. Oxytitanium phthalocyanine and gallium phthalocyanine in particular have excellent sensitivity properties, and various crystal forms have been reported until now.

Although an electrophotographic photosensitive member using a phthalocyanine pigment has excellent sensitivity properties, a problem is that the generated photo carriers tend to remain in a photosensitive layer so as to act as a memory, easily causing potential variation such as ghosting.

Japanese Patent Application Laid-Open No. 2012-32781 discloses that the addition of a specific amine compound to a charge generation layer can reduce ghosting.

Japanese Patent Application Laid-Open No. 2007-182556 discloses that the use of a resin having a specific triphenylamine skeleton as a resin for a charge generation layer can improve dispersibility and optical sensitivity.

Various attempts have been made to improve electrophotographic photosensitive members as described above.

For further improvement in high-quality picture in recent years, it is desired to further prevent image degradation due to ghosting in various environments.

SUMMARY OF THE INVENTION

The present invention is directed to solving the problem and to providing an electrophotographic photosensitive member which can output images with reduced image defects due to ghosting not only under a normal temperature and normal humidity environment but also even under a low temperature and low humidity environment, especially severe conditions. Further, the present invention is directed to providing a process cartridge and an electrophotographic apparatus each having the electrophotographic photosensitive member.

According to one aspect of the present invention, there is provided an electrophotographic photosensitive member comprising: a support; and a photosensitive layer formed on the support; wherein the photosensitive layer includes: (a) a gallium phthalocyanine crystal, (b) an amine compound represented by the following formula (1), and (c) a polyvinylacetal resin having a repeating structural unit represented by the following formula (2):

(1)

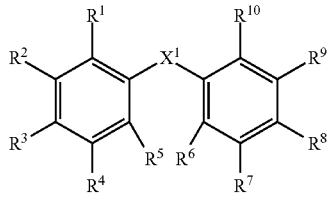

wherein $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group; and at least one of $R^1$ to $R^{10}$ represents an amino group substituted with a substituted or unsubstituted aryl group, an amino group substituted with a substituted or unsubstituted alkyl group, or a substituted or unsubstituted cyclic amino group; and $X^1$ represents a carbonyl group or a dicarbonyl group:

(2)

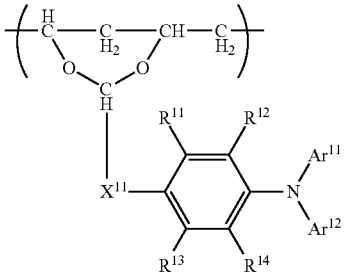

wherein $X^{11}$ represents a substituted or unsubstituted ethylene group, a substituted or unsubstituted propylene group, or a substituted or unsubstituted butylene group; $R^{11}$, $R^{12}$, $R^{13}$ and $R^{14}$ each independently represent a hydrogen atom, an alkyl group or a methoxy group; and $Ar^{11}$ and $Ar^{12}$ each independently represent a phenyl group having at least one electron donating substituent.

According to another aspect of the present invention, there is provided a process cartridge which integrally supports the electrophotographic photosensitive member and at least one unit selected from the group consisting of a charging unit for charging the surface of the electrophotographic photosensitive member, a developing unit for developing an electrostatic latent image formed on the surface of the electrophotographic photosensitive member with toner to form a toner image, and a cleaning unit for removing the toner on the surface of the electrophotographic photosensitive member after transfer of the toner image to a transfer material, the cartridge being detachably mountable to a main body of an electrophotographic apparatus.

According to further aspect of the present invention, there is provided an electrophotographic apparatus having the electrophotographic photosensitive member, as well as a charging unit for charging the surface of the electrophotographic photosensitive member, an image exposure unit for irradiating the charged surface of the electrophotographic photosensitive member with image exposing light to form an electrostatic latent image, a developing unit for developing the electrostatic latent image formed on the surface of the electrophotographic photosensitive member with toner to form a toner image, and a transferring unit for transferring the toner image formed on the surface of the electrophotographic photosensitive member to a transfer material.

The present invention can provide an electrophotographic photosensitive member which can output images with reduced image defects due to ghosting not only under a normal temperature and normal humidity environment but also even under a low temperature and low humidity environment, especially severe conditions. The present invention can also provide a process cartridge and an electrophotographic apparatus each having the electrophotographic photosensitive member.

Further features of the present invention will become apparent from the following description of exemplary embodiments with reference to the attached drawings.

DESCRIPTION OF THE EMBODIMENTS

Figure 1:
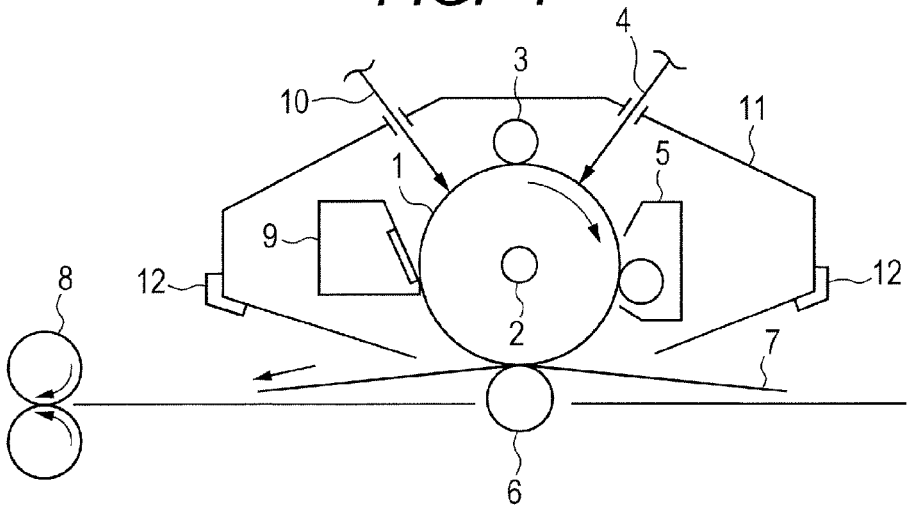
FIG. 1 is a schematic view of an electrophotographic apparatus provided with a process cartridge having an electrophotographic photosensitive member.

Preferred embodiments of the present invention will now be described in detail in accordance with the accompanying drawings.

As described above, the electrophotographic photosensitive member of the present invention includes: a support; and a photosensitive layer formed on the support;

wherein the photosensitive layer includes (a) a gallium phthalocyanine crystal, (b) an amine compound represented by the following formula (1), and (c) a polyvinylacetal resin having a repeating structural unit represented by the following formula (2):

(1)

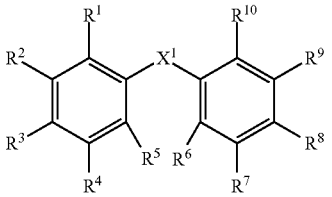

In the formula (1), $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group. At least one of $R^1$ to $R^{10}$ represents an amino group substituted with a substituted or unsubstituted aryl group, an amino group substituted with a substituted or unsubstituted alkyl group, or a substituted or unsubstituted cyclic amino group. $X^1$ represents a carbonyl group or a dicarbonyl group.

(2)

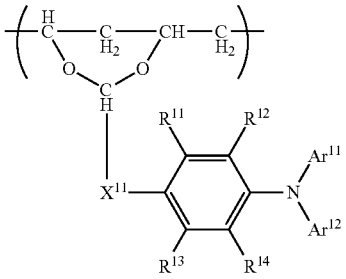

In the formula (2), $X^{11}$ represents a substituted or unsubstituted ethylene group, a substituted or unsubstituted propylene group, or a substituted or unsubstituted butylene group. $R^{11}$, $R^{12}$, $R^{13}$ and $R^{14}$ each independently represent a hydrogen atom, an alkyl group or a methoxy group. $Ar^{11}$ and $Ar^{12}$ each independently represent a phenyl group having at least one electron donating substituent.

At least one of the $R^1$ to $R^{10}$ in the formula (1) can be an amino group substituted with a substituted or unsubstituted alkyl group. It is more preferred that the substituted or unsubstituted alkyl group is an alkyl group substituted with an alkoxy group, an alkyl group substituted with an aryl group, or an unsubstituted alkyl group in particular.

Furthermore, the $R^1$ to $R^{10}$ in the formula (1) can be a dialkylamino group. A dimethylamino group or a diethylamino group in particular is more preferred.

At least one of the $R^1$ to $R^{10}$ in the formula (1) can also be a substituted or unsubstituted cyclic amino group. The cyclic amino group can be a 3 to 8-membered cyclic amino group, of which at least one constituent carbon atom may be substituted with an oxygen atom, a nitrogen atom or the like. A 6-membered cyclic amino group such as a morpholino group and a piperidino group in particular is more preferred.

Examples of the amine compound which has an especially preferable effect for reducing image defects due to ghosting include 4,4'-bis(diethylamino)benzophenone.

Examples of the substituent which each of the substituted or unsubstituted acyl group, the substituted or unsubstituted alkyl group, the substituted or unsubstituted alkoxy group, the substituted or unsubstituted aryloxy group, the substituted or unsubstituted amino group, the substituted or unsubstituted aryl group, and the substituted or unsubstituted cyclic amino group in the formula (1) may include: an alkyl group such as a methyl group, an ethyl group, a propyl group and a butyl group; an alkoxy group such as a methoxy group and an ethoxy group; a dialkylamino group such as a dimethylamino group and a diethylamino group; an alkoxycarbonyl group such as a methoxycarbonyl group and an ethoxycarbonyl group; an aryl group such as a phenyl group, a naphthyl group and a biphenylyl group; a halogen atom such as a fluorine atom, a chlorine atom and a bromine atom; a nitro group; a cyano group; and a halomethyl group. An aryl group and an alkoxy group are preferred substituents among them.

Each of the substituted or unsubstituted acyl group, the substituted or unsubstituted alkyl group, the substituted or unsubstituted alkoxy group, the substituted or unsubstituted aryloxy group, the substituted or unsubstituted amino group, the substituted or unsubstituted aryl group, and the substituted or unsubstituted cyclic amino group in the formula (1) may include, for example, the following substituent: an alkyl group such as a methyl group, an ethyl group, a propyl group and a butyl group; an alkoxy group such as a methoxy group and an ethoxy group; a dialkylamino group such as a dimethylamino group and a diethylamino group; an alkoxycarbonyl group such as a methoxycarbonyl group and an ethoxycarbonyl group; an aryl group such as a phenyl group, a naphthyl group and a biphenylyl group; a halogen atom such as a fluorine atom, a chlorine atom and a bromine atom; a hydroxy group; a nitro group; a cyano group; or a halomethyl group. An aryl group and an alkoxy group are preferred substituents among them.

Although preferable specific examples (exemplary compounds) of the amine compound contained in the photosensitive layer of the electrophotographic photosensitive member of the present invention are described in the following, the present invention is not limited thereto.

Exemplary compound (1)

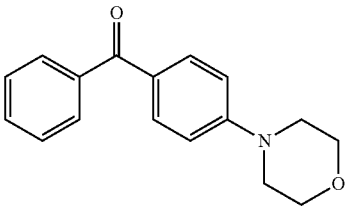

Exemplary compound (2)

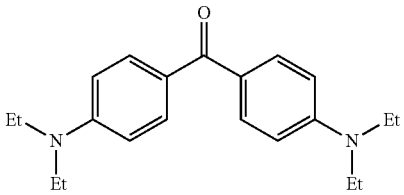

Exemplary compound (3)

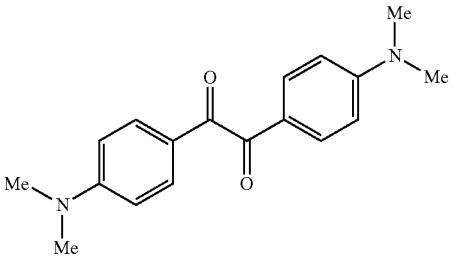

Exemplary compound (4)

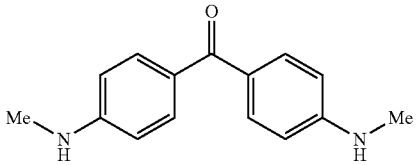

Exemplary compound (5)

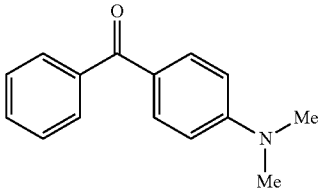

-continued

Exemplary compound (6)

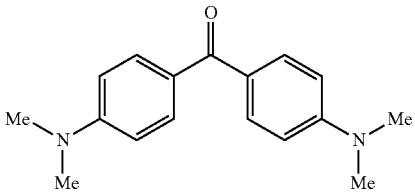

Exemplary compound (7)

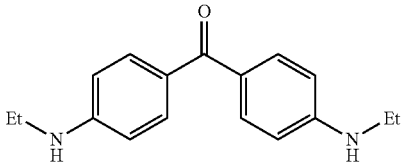

Exemplary compound (8)

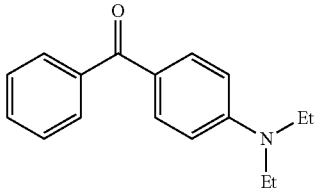

Exemplary compound (9)

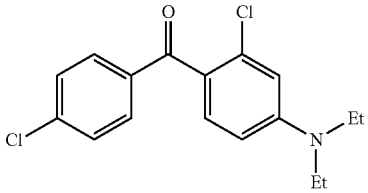

Exemplary compound (10)

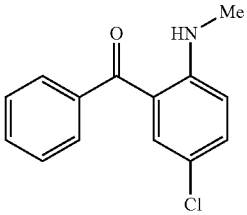

Exemplary compound (11)

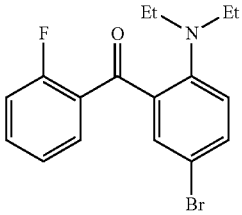

Exemplary compound (12)

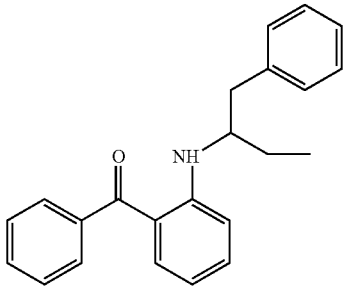

-continued

Exemplary compound (13)

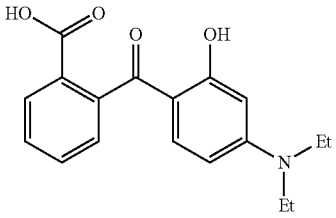

Exemplary compound (14)

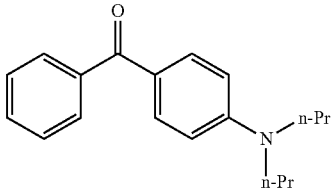

Exemplary compound (15)

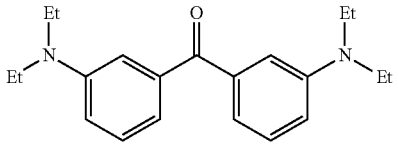

Exemplary compound (16)

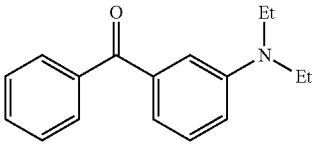

Exemplary compound (17)

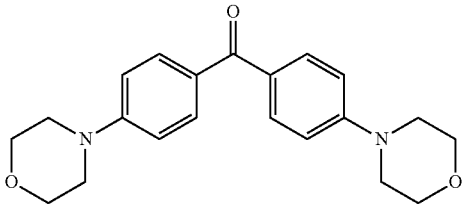

Exemplary compound (18)

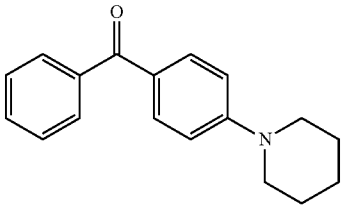

Exemplary compound (19)

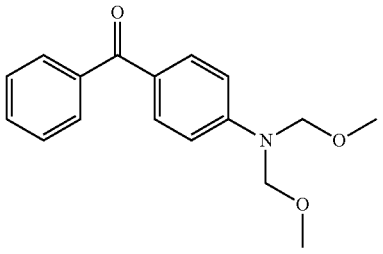

-continued

Exemplary compound (20)

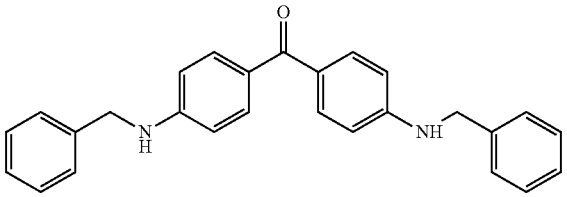

Exemplary compound (21)

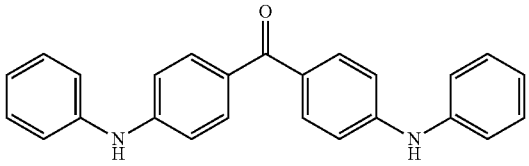

Exemplary compound (22)

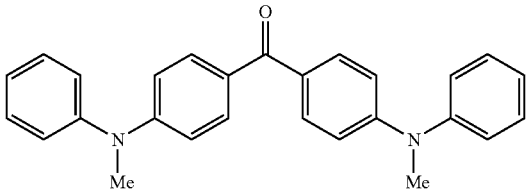

Exemplary compound (23)

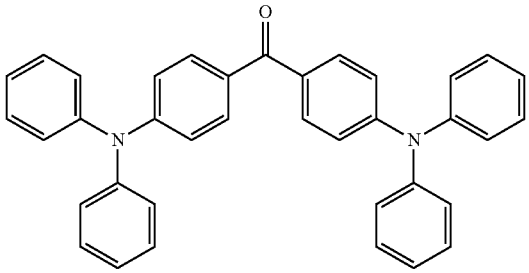

Exemplary compound (24)

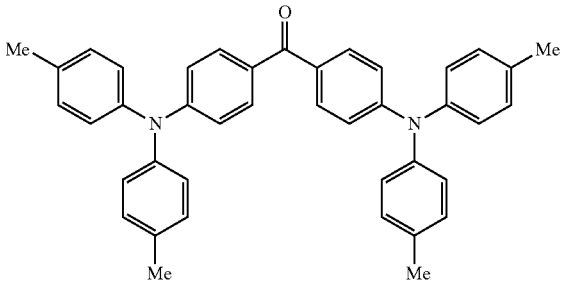

In the exemplary compounds, Me represents a methyl group, Et represents an ethyl group, and n-Pr represents a propyl group (n-propyl group).

Examples of the gallium phthalocyanine crystal of the present invention include a gallium phthalocyanine molecule of which gallium atom has an axial ligand of a halogen atom, a hydroxy group or an alkoxy group. The phthalocyanine ring may include a substituent such as a halogen atom.

A gallium phthalocyanine crystal further containing N,N-dimethylaminoformamide in the crystal is preferred.

Among gallium phthalocyanine crystals, a hydroxygallium phthalocyanine crystal, a bromo-gallium phthalocyanine crystal and an iodo-gallium phthalocyanine crystal, having excellent sensitivity, are preferred, being effective for the present invention. The hydroxygallium phthalocyanine crystal includes a gallium atom having an axial ligand of hydroxy group. The bromo-gallium phthalocyanine crystal includes a gallium atom having an axial ligand of bromine atom. The iodo-gallium phthalocyanine crystal includes a gallium atom having an axial ligand of iodine atom. The hydroxygallium phthaobyanine crystal is preferred in particular.

A hydroxygallium phthalocyanine crystal having peaks at Bragg angles 2θ of 7.4°±0.3° and 28.3°±0.3° in X-ray diffraction with CuKα radiation in particular is more preferred, having effect of reducing image defects due to ghosting.

A gallium phthalocyanine crystal in which a compound represented by the formula (1) is contained is particularly preferred, having a significant effect for reducing ghosting.

In the phthalocyanine crystal which contains a compound represented by the formula (1) in the crystal, the compound represented by the formula (1) is incorporated into the crystal.

A manufacturing method of a phthalocyanine crystal which contains a compound represented by the formula (1) in the crystal is described below.

The phthalocyanine crystal which contains a compound represented by the formula (1) in the crystal can be obtained by mixing phthalocyanine produced by acid pasting and a compound represented by the formula (1) with a solvent and by wet milling treatment for conversion into crystals.

The milling treatment is a treatment in a milling device such as a sand mill and a ball mill, using dispersion material such as glass beads, steel beads and alumina balls. The milling time can be about 10 to 60 hours. In a particularly preferred method, sampling is performed with an interval of 5 to 10 hours for examining the Bragg angle of the crystal. The amount of dispersion material in milling treatment can be 10 to 50 times the amount of gallium phthalocyanine by mass. Examples of the solvent for use include an amide solvent such as N,N-dimethylformamide, N,N-dimethylacetoamide, N-methylformamide, N-methylacetoamide and N-methylpropionamide, a halogen solvent such as chloroform, an ether solvent such as tetrahydrofuran, a sulfoxide solvent such as dimethyl sulfoxide. The amount of solvent used can be 5 to 30 times the amount of phthalocyanine by mass. The amount of a compound represented by the formula (1) used can be 0.1 to 30 times the amount of phthalocyanine by mass.

In the present invention, the measurement data of the obtained phthalocyanine crystal by NMR measurement and thermogravimetric (TG) measurement are analyzed to determine whether the phthalocyanine crystal contained a compound represented by the formula (1) in the crystal.

For example, when a milling treatment was performed with a solvent for dissolving a compound represented by the formula (1) or when a cleaning was performed after milling, NMR measurement of the obtained phthalocyanine crystal was performed. When a compound represented by the formula (1) was detected from the obtained phthalocyanine crystal, it was determined that a compound represented by the formula (1) was contained in the crystal.

On the other hand, when a compound represented by the formula (1) was insoluble in the solvent for use in the milling treatment and insoluble in the cleaning solvent after milling, NMR measurement of the obtained phthalocyanine crystal was performed. When a compound represented by the formula (1) was detected, determination was performed by the following method.

The TG measurement of each of the phthalocyanine crystal obtained by adding a compound represented by the formula (1) (amine compound), a phthalocyanine crystal prepared in the same way except that no amine compound was added, and a compound represented by the formula (1) alone was individually performed. When the TG measurement results of the phthalocyanine crystal obtained by adding an amine compound were interpreted from a mixture of the individual measurement results of the phthalocyanine crystal prepared without addition of a compound represented by the formula (1) and an amine compound in a predetermined ratio, it was determined that the phthalocyanine crystal and an amine compound formed a simple mixture or that an amine compound was attached to the surface of the phthalocyanine crystal.

On the other hand, when the TG measurement results of the phthalocyanine crystal obtained by adding an amine compound showed the weight reduction increase at a temperature higher than the completion temperature of the weight reduction for the amine compound alone in comparison with the TG measurement results of the phthalocyanine crystal prepared without addition of an amine compound, it was determined that an amine compound was contained in the phthalocyanine crystal.

The TG measurement, the X-ray diffraction analysis and the NMR measurement of the phthalocyanine crystal were performed under the following conditions.

[TG Measurement]

Measurement instrument: A simultaneous TG/DTA measurement device made by Seiko Instruments Inc. (Trade name: TG/DTA 220U)

Atmosphere: Nitrogen stream (300 $cm^3$/min)

Measurement range: 35° C. to 600° C.

Rate of temperature increase: 10° C./min

[Powder X-Ray Diffraction Analysis]

Measurement instrument: X-ray diffraction analyzer RINT-TTRII made by Rigaku Corporation X-ray tube: Cu X-ray tube voltage: 50 KV X-ray tube current; 300 mA Scanning method: 2θ/θ scan Scanning rate: 4.0°/min Sampling interval: 0.02°

Starting angle (2θ): 5.0°

Stopping angle (2θ): 40.0°

Attachment: Standard sample holder

Filter: non-use

Incident monochrome: in-use

Counter monochrometer: non-use

Divergence slit: open

Vertical divergence limiting slit: 10.00 mm

Scattering slit: open

Light receiving slit: open

Flat plate monochrometer: in use

Counter: scintillation counter

[NMR Measurement]

Measurement instrument: AVANCE III 500 made by Bruker

Solvent: deuterium sulfate ($D_2SO_4$)

The polyvinylacetal resin having a repeating structural unit represented by the formula (2) can be synthesized by the same method for a common butylal resin. Namely, polyvinyl alcohol and aldehyde having a triarylamine skeleton with an electron donating substituent are reacted in a mixed solvent, for example, of ethanol and toluene under the presence of an acid such as hydrochloric acid and sulfuric acid, at 20 to 70° C. so as to achieve the synthesis.

The polyvinylacetal resin preferably has a weight average molecular weight in a range of 10000 to 500000, more preferably 30000 to 100000. An excessively small molecular weight may cause insufficient dispersion stability of charge generation substances and insufficient film formability of a layer in some cases. An excessively large molecular weight easily causes a trouble in handling during synthesis and may also cause defective dispersion due to high viscosity during dispersion of charge generation substances in some cases.

The polyvinylacetal resin of the present invention preferably has a degree of acetalization of 30 mol % or more, more preferably 50 to 85 mol %. An excessively low degree of acetalization may cause excessively low solubility of the resin in a solvent in some cases and may exert an insufficient effect of the present invention due to the reduced number of the triarylamine skeletons with an electron donating substituent in some cases. On the other hand, a resin having a degree of acetalization of 85 mol % or more is difficult to be synthesized.

In the present invention, the lower content ratio of remaining vinyl acetate components derived from a raw material polyvinyl alcohol is more preferred. The raw material polyvinyl alcohol having a degree of saponification of 85% or more can be used. A degree of saponification less than 85% easily causes a low degree of acetalization.

Examples of the electron donating substituent include an alkyl group such as a methyl group, an ethyl group and a propyl group, an alkoxy group such as a methoxy group and an ethoxy group, a phenyl group, a phenoxy group and a benzyl group.

The polyvinylacetal resin for use in the photosensitive layer (charge generation layer) of an electrophotographic photosensitive member may be mixed together with another resin. The mixing ratio of the polyvinylacetal resin of the present invention is preferably 50% by mass or more relative to the total mass of the resin, more preferably 70% by mass or more.

Specific examples (exemplary resins) of the polyvinylacetal resin are described in the following Table 1. The following $X^{11}$, $R^{11}$, $R^{12}$, $R^{13}$, $R^{14}$, $Ar^{11}$ and $Ar^{12}$ are the $X^{11}$, $R^{11}$, $R^{12}$, $R^{13}$, $R^{14}$, $Ar^{11}$ and $Ar^{12}$ in the general formula (2), respectively.

TABLE 1

| | $X^{11}$ | $R^{11}$ | $R^{12}$ | $R^{13}$ | $R^{14}$ | $Ar^{11}$ | $Ar^{12}$ |
|---|---|---|---|---|---|---|---|
| Exemplary resin (1) | $—(CH_2)_2—$ | —H | —H | —H | —H | 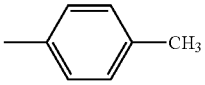 | 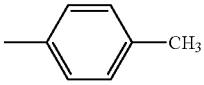 |
| Exemplary resin (2) | $—(CH_2)_2—$ | —H | —H | —H | —H | 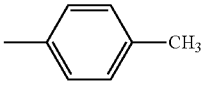 | 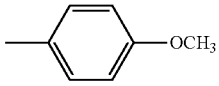 |
| Exemplary resin (3) | $—(CH_2)_2—$ | —H | —H | —H | —H | 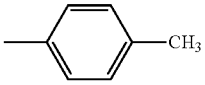 | 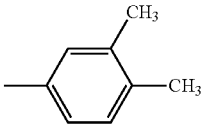 |
| Exemplary resin (4) | $—(CH_2)_2—$ | —H | —H | —H | —H | 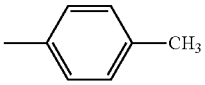 | 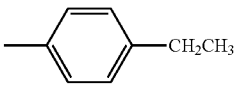 |
| Exemplary resin (5) | $—(CH_2)_2—$ | —H | —H | —H | —H | 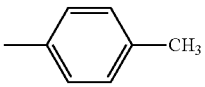 | 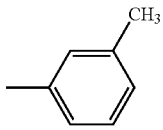 |
| Exemplary resin (6) | $—(CH_2)_2—$ | —H | —H | —H | —H | 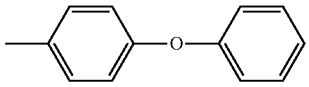 | 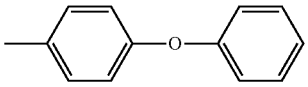 |
| Exemplary resin (7) | $—(CH_2)_2—$ | —H | —H | —H | —H | 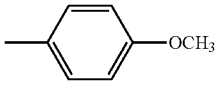 | 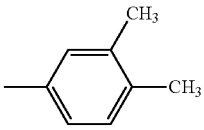 |
| Exemplary resin (8) | $—(CH_2)_2—$ | —H | —H | —H | —H | 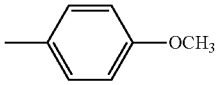 | 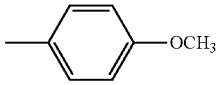 |
| Exemplary resin (9) | $—(CH_2)_2—$ | —H | —H | —H | —H | 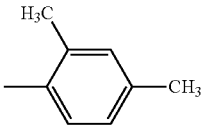 | 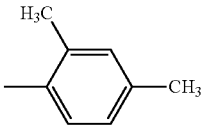 |

TABLE 1-continued

| | $X^{11}$ | $R^{11}$ | $R^{12}$ | $R^{13}$ | $R^{14}$ | $Ar^{11}$ | $Ar^{12}$ |
|---|---|---|---|---|---|---|---|
| Exemplary resin (10) | $-(CH_2)_2-$ | —H | —H | —H | —H | 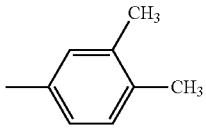 | 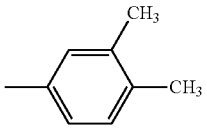 |
| Exemplary resin (11) | $-(CH_2)_2-$ | $-CH_3$ | —H | —H | —H | 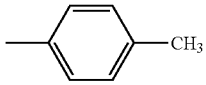 | 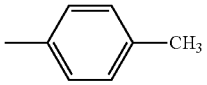 |
| Exemplary resin (12) | $-(CH_2)_3-$ | —H | —H | —H | —H | 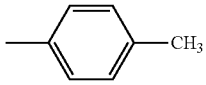 | 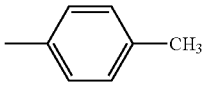 |
| Exemplary resin (13) | $-(CH_2)_4-$ | —H | —H | —H | —H | 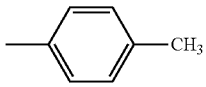 | 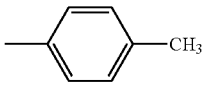 |

In the formula (2), the $X^{11}$ can be an ethylene group (unsubstituted ethylene group). Each of the $R^{11}$, $R^{12}$, $R^{13}$ and $R^{14}$ can be a hydrogen atom. The electron donating substituent which the $Ar^{11}$ and $Ar^{12}$ have can be an alkyl group. A methyl group and an ethyl group in particular are more preferred.

A photosensitive layer of the electrophotographic photosensitive member of the present invention may be a single-layered photosensitive layer having a single layer in which a charge generation substance and a charge transport substance are contained; and a laminated photosensitive layer having a charge generation layer which contains a charge generation substance and a charge transport layer which contains a charge transport substance. A laminated photosensitive layer is preferred from the view point of electrophotographic properties. Among the laminated photosensitive layer, a photosensitive layer laminated in normal sequence, i.e. a charge generation layer and a charge transport layer in this order from the support side, is more preferred.

The charge generation layer of the photosensitive layer of a laminated photosensitive layer can include the (a), (b) and (c).

The charge generation layer of the photosensitive layer of a laminated photosensitive layer can be formed as in the following. Namely, (a) a gallium phthalocyanine crystal, (b) an amine compound, and (c) a polyvinylacetal resin are dissolved in a solvent to form a liquid, which is mixed and dispersed to prepare a coating liquid for forming a charge generation layer. The coating liquid for forming a charge generation layer is applied to a support so as to form a coating film. The coating film is dried to form a charge generation layer.

In dispersing, a dispersion device can be used, including a medium type dispersion device such as a sand mill and a ball mill and a liquid collision type dispersion device.

The ratio among (a) the gallium phthalocyanine crystal, (b) the amine compound and (c) the polyvinylacetal resin in the charge generation layer can be in the range of {(a)+(b)}:(c)=5:1 to 1:2 (mass ratio).

The ratio between (a) the gallium phthalocyanine crystal and (b) the amine compound can be in the range of (a):(b)=99.5:0.5 to 80:20 (mass ratio).

The charge generation layer preferably has a film thickness of 5 μm or less, more preferably 0.05 to 1 μm.

The charge transport layer of the photosensitive layer of a laminated photosensitive layer can be formed by applying a coating liquid for forming a charge transport layer, which is prepared by dissolving a charge transport substance and a binder resin in a solvent, to the charge generation layer, and drying the produced coating film.

Examples of the charge transport substance include a triarylamine compound, a hydrazone compound, a stilbene compound, a pyrazoline compound, an oxazole compound, a thiazole compound and a triallylmethane compound.

Examples of the binder resin in the charge transport layer include a polyester resin, an acrylic resin, a polyvinyl carbazole resin, a phenoxy resin, a polycarbonate resin, a polyvinylbutyral resin, a polystyrene resin, polyvinyl acetate resin, a polysulfone resin, a polyarylate resin and a vinylidene chloride-acrylonitrile copolymer resin.

The charge transport layer preferably has a film thickness of 4 to 35 μm, more preferably 8 to 20 μm.

The photosensitive layer of a single-layered photosensitive layer can be formed by adding a charge transport substance and another resin on an as needed basis to the same liquid as the coating liquid for forming a charge generation layer so as to prepare a coating liquid for forming a single-layered photosensitive layer, applying the coating liquid to a support, and drying the coating.

The ratio among (a) the gallium phthalocyanine crystal, (b) the amine compound and (c) the polyvinylacetal resin in a single-layered photosensitive layer can be in the range of {(a)+(b)}:(c)=1:1 to 1:5 (mass ratio).

The preferred range of the ratio between (a) the gallium phthalocyanine crystal and (b) the amine compound in a single-layered photosensitive layer is the same as that of the charge generation layer of a laminated photosensitive layer.

The single-layered photosensitive layer preferably has a film thickness of 5 to 30 μm, more preferably 8 to 20 μm.

A support having electrical conductivity (conductive support) can be used as the support in the electrophotographic photosensitive member of the present invention. The support may be made of, for example, aluminum, aluminum alloy, copper, zinc, stainless steel, vanadium, molybdenum, chromium, titanium, nickel, indium, gold or platinum.

Alternatively, a support may be made of: a plastic (e.g. polyethylene, polypropylene, polyvinylchloride, polyethylene terephthalate and an acrylic resin) coated with a vacuum deposited layer of such a metal or alloy; a plastic, metal or alloy base coated with conductive particles (e.g. carbon black and silver particles) and a binder resin; or a plastic or paper impregnated with conductive particles.

Examples of the shape of a support include a drum shape, a sheet shape and a belt shape. The shape most suitable for an electrophotographic apparatus for use can be employed.

An undercoat layer (intermediate layer) having a function such as a barrier function and an adhesive function may be disposed between the support and the photosensitive layer. The undercoat layer can be made from, for example, casein, polyvinyl alcohol, nitro cellulose, polyamide (e.g. nylon 6, nylon 66, nylon 610, copolymer nylon and alkoxymethylated nylon), polyurethane and aluminum oxide.

The undercoat layer preferably has a film thickness of 20 μm or less, more preferably 0.5 to 5 μm.

A protective layer may be provided on the photosensitive layer so as to protect the photosensitive layer and improve the durability of an electrophotographic photosensitive member.

The protective layer can be formed by applying a coating liquid for forming a protective layer, which is prepared by dissolving a binder resin in a solvent, to the photosensitive layer, and drying the produced coating film. Examples of the binder resin used in the protective layer include polyvinylbutyral, polyester, polycarbonate (e.g. polycarbonate Z and modified polycarbonate), polyamide, polyimide, polyarylate, polyurethane, styrene-butadiene copolymer, styrene-acrylic acid copolymer and styrene-acrylonitrile copolymer. Alternatively the protective layer may be formed by curing the coating film of the coating liquid for forming a protective layer by exposure to electron beams or ultraviolet rays. The protective layer can have a film thickness of 0.1 to 10 μm.

The protective layer may contain conductive particles, an ultraviolet absorbing agent, or lubricating particles such as fluorine atom-containing resin particles. Examples of the conductive particles can include metal oxide particles such as tin oxide and silica.

FIG. 1 is a schematic view of an electrophotographic apparatus provided with a process cartridge having an electrophotographic photosensitive member.

An electrophotographic photosensitive member 1 having a cylindrical shape (drum shape), is rotation driven around an axis 2 at a predetermined circumferential speed (process speed) in an arrow direction.

The surface of the electrophotographic photosensitive member 1 is electrostatically charged to a positive or negative predetermined potential with a charging unit 3 during in a rotation process. Subsequently the charged surface of the electrophotographic photosensitive member 1 is irradiated with image exposing light 4 from an image exposure unit (not drawn in figure) so as to form an electrostatic latent image corresponding to objective image information. The image exposing light 4 are intensity-modulated in response to the time-series electric digital image signals of objective image information, outputted from, for example, an image exposure unit for slit exposing or exposing with scanning laser beams.

The electrostatic latent image formed on the surface of the electrophotographic photosensitive member 1 is developed (normal development or reversal development) with toner stored in a developing unit 5 so as to form a toner image on the surface of the electrophotographic photosensitive member 1. The toner image formed on the surface of the electrophotographic photosensitive member 1 is transferred to a transfer material 7 with a transferring unit 6. On this occasion, a bias voltage having a polarity reversal of the charge retained on the toner is applied to the transferring unit 6 from a bias power supply (not drawn in figure). A transfer material 7 of paper is taken out from a paper feeding part (not drawn in figure) so as to be fed between the electrophotographic photosensitive member 1 and the transferring unit 6 in synchronization with the rotation of the electrophotographic photosensitive member 1.

The transfer material 7 having a toner image transferred from the electrophotographic photosensitive member 1 is separated from the surface of the electrophotographic photosensitive member 1 and transported to an image fixation device 8 for the fixation of the toner image. An image formed object (print or copy) is thus printed out from an electrophotographic apparatus.

After transfer of the toner image to the transfer material 7, the surface of the electrophotographic photosensitive member 1 is cleaned with a cleaning device 9 to remove attached material such as toner (remaining toner after transfer). In a recently developed cleaner-less system, toner may be directly removed after transfer with a development apparatus or the like. Subsequently the surface of the electrophotographic photosensitive member 1 is neutralized with pre-exposing light 10 from a pre-exposing device (not drawn in figure) and then repeatedly used for image formation. The pre-exposing device is not necessarily required for a contact charging device 3 having a charging roller.

In the present invention, a plurality of components selected from the group consisting of the electrophotographic photosensitive member 1, the charging device 3, the developing device 5 and the cleaning device 9 may be contained in a container and integrally supported to form a process cartridge detachable to an electrophotographic apparatus body. For example, at least one selected from the group consisting of the charging device 3, the developing device 5 and the cleaning device 9 is integrally supported together with the electrophotographic photosensitive member 1 so as to form a cartridge. The cartridge constitutes a process cartridge 11 detachable to an electrophotographic apparatus body with a guiding device 12 such as a rail of the electrophotographic apparatus body.

Image exposing light 4 may be reflected beams from or transmitted beams through a sheet of manuscript for an electrophotographic apparatus such as a copy machine and a printer. Alternatively, image exposing light 4 may be radiated beams produced by scanning of laser beams, driving of an LED array or driving of a liquid crystal shutter array in response to signals from a manuscript reading sensor.

The electrophotographic photosensitive member 1 of the present invention can be widely used in an electrophotography application field such as a laser beam printer, a CRT printer, an LED printer, a FAX, a liquid crystal printer and a laser engraving.

EXAMPLES

The present invention is described further in detail in reference to specific Examples in the following. In the following, "parts" means "parts by mass." However, the present invention is not limited thereto. The film thickness of each of the layers of electrophotographic photosensitive members in Examples and Comparative Examples was obtained with an eddy-current film thickness meter (Fischerscope made by Fischer Instruments K.K.), or based on the specific gravity converted from a mass per unit area.

Example 1-1

Figure 2:
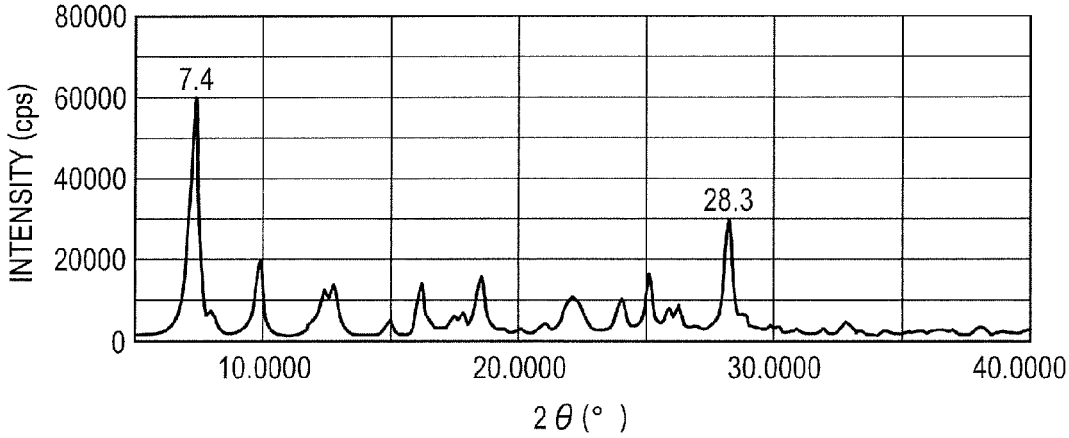
FIG. 2 is a powder X-ray diffraction chart of a hydroxygallium phthalocyanine crystal obtained in Example 1-1.

Hydroxygallium phthalocyanine was prepared by the same treatment as in the synthesis example 1 and the subsequent example 1-1 described in Japanese Patent Application Laid- Open No. 2011-94101. Then, 0.5 parts of the hydroxygallium phthalocyanine, 1.0 part of the exemplary compound (1) (product code: 159400050, made by Acros Organics), and 10 parts of N,N-dimethylformamide were put in a ball mill with 20 parts of glass beads having a diameter of 0.8 mm so as to be milled at room temperature (23° C.) for 40 hours. A gallium phthalocyanine crystal was produced from the dispersion liquid using N,N-dimethylformamide. In filtration, the strainer was sufficiently cleaned with tetrahydrofuran. The filter residue was vacuum dried so that 0.50 parts of hydroxygallium phthalocyanine crystal was obtained. The powder X-ray diffraction chart of the produced hydroxygallium phthalocyanine crystal is illustrated in FIG. 2.

By NMR measurement, it was confirmed based on the conversion from proton ratio that 0.31% by mass of the exemplary compound (1) and 2.05% by mass of N,N-dimethylformamide were contained in the phthalocyanine crystal. Since the exemplary compound (1) is soluble in N,N-dimethylformamide, it was found that the exemplary compound (1) was contained in the crystal.

Example 1-2

Figure 3:
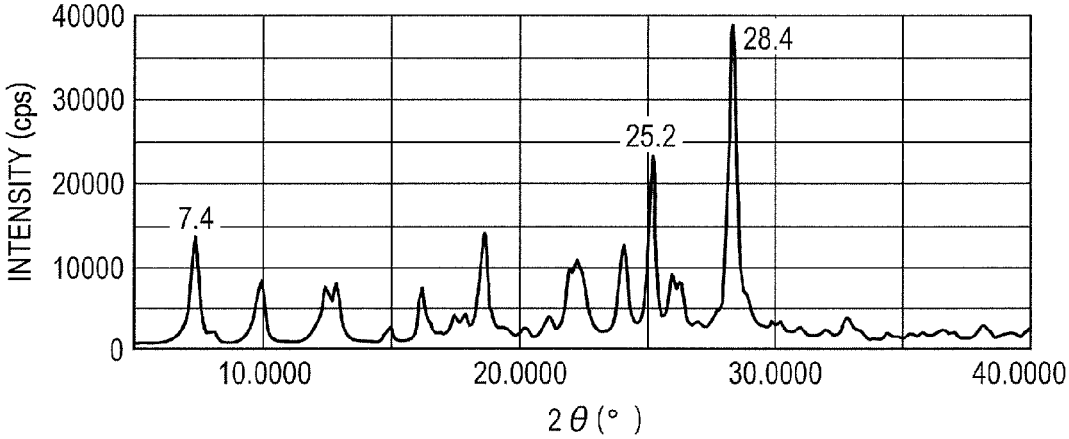
FIG. 3 is a powder X-ray diffraction chart of a hydroxygallium phthalocyanine crystal obtained in Example 1-2.

In Example 1-1, 1.0 part of the exemplary compound (1) was replaced with 0.5 parts of the exemplary compound (2) (product code: B0139, made by Tokyo Chemical Industry Co., Ltd.), and the milling treatment time was changed from 40 hours to 55 hours. 0.46 parts of hydroxygallium phthalocyanine crystal was obtained by the same treatment as in Example 1-1 except for the above. The powder X-ray diffraction chart of the produced crystal is illustrated in FIG. 3.

By NMR measurement, it was confirmed based on the conversion from proton ratio that 0.16% by mass of the exemplary compound (2) and 1.88% by mass of N,N-dimethylformamide were contained in the hydroxygallium phthalocyanine crystal. Since the exemplary compound (2) is soluble in N,N-dimethylformamide, it was found that the exemplary compound (2) was contained in the crystal.

Example 1-3

1.0 part of the exemplary compound (1) in Example 1-1 was replaced with 1.0 part of the exemplary compound (4) (product code: B1433, made by Tokyo Chemical Industry Co., Ltd.). 0.50 parts of hydroxygallium phthalocyanine crystal was obtained by the same treatment as in Example 1-1 except for the above. The powder X-ray diffraction chart of the produced hydroxygallium phthalocyanine crystal was the same as in FIG. 2.

By NMR measurement, it was confirmed that based on the conversion from proton ratio 0.28% by mass of the exemplary compound (4) and 2.14% by mass of N,N-dimethylformamide were contained in the phthalocyanine crystal. Since the exemplary compound (4) is soluble in N,N-dimethylformamide, it was found that the exemplary compound (4) was contained in the crystal.

Example 1-4

In Example 1-1, 1.0 part of the exemplary compound (1) was replaced with 1.0 part of the exemplary compound (24) obtained in the synthesis example. 0.34 parts of hydroxygallium phthalocyanine crystal was obtained by the same treatment as in Example 1-1 except for the above. The powder X-ray diffraction chart of the produced hydroxygallium phthalocyanine crystal was the same as in FIG. 2.

By NMR measurement, it was confirmed that based on the conversion from proton ratio 0.16% by mass of the exemplary compound (24) and 2.21% by mass of N,N-dimethylformamide were contained in the hydroxygallium phthalocyanine crystal. Since the exemplary compound (24) is soluble in N,N-dimethylformamide, it was found that the exemplary compound (24) was contained in the crystal.

Example 1-5

Except that the exemplary compound (1) was not added, 0.40 parts of hydroxygallium phthalocyanine crystal was obtained by the same treatment as in Example 1-1. The powder X-ray diffraction chart of the produced hydroxygallium phthalocyanine crystal was the same as in FIG. 2.

By NMR measurement, it was confirmed that based on the conversion from proton ratio 1.93% by mass of N,N-dimethylformamide was contained in the phthalocyanine crystal.

Example 2-1

Firstly, a solution of 60 parts of barium sulfate particles coated with tin oxide (trade name: Passtran PC1, made by Mitsui Mining & Smelting Co., Ltd.), 15 parts of titanium oxide particles (trade name: TITANIX JR, made by Tayca Corporation), 43 parts of a resol-type phenol resin (trade name: Phenolite J-325 made by DIC Corporation, solid content: 70% by mass), 0.015 parts of silicone oil (trade name: SH28PA, made by Dow Corning Toray Co., Ltd.), 3.6 parts of silicone resin (trade name: Tospearl 120, made by Momentive Performance Materials Inc.), 50 parts of 2-methoxy-1-propanol, and 50 parts of methanol were put in a ball mill, and dispersed for 20 hours so as to prepare a coating liquid for forming a conductive layer.

The coating liquid for forming a conductive layer was applied on aluminum cylinder (diameter: 24 mm) as a support with immersion coating, and the produced coating film was dried at 140° C. for 30 minutes so that a conductive layer having a film thickness of 15 μm was formed.

Subsequently 10 parts of copolymer nylon resin (trade name: Amilan CM8000, made by Toray Industries, Inc.) and 30 parts of methoxymethylated 6-nylon resin (trade name: Tresin EF-30T, made by Nagase Chemtex Corporation) were dissolved in a mixed solvent of 400 parts of methanol and 200 parts of n-butanol so as to prepare a coating liquid for forming an undercoat layer.

The coating liquid for forming an undercoat layer was applied to the conductive layer with immersion coating, and the produced coating film was dried so that an undercoat layer having a film thickness of 0.5 μm was formed.

Subsequently, 10 parts of the hydroxygallium phthalocyanine crystal (charge generation substance) produced in Example 1-5, 0.2 parts of the exemplary compound (1), 5 parts of the exemplary resin (1), and 250 parts of cyclohexanone were put in a sand mill with glass beads having a diameter of 1 mm for dispersion treatment for 3 hours. To the dispersion liquid, 250 parts of ethyl acetate was added to dilute it, thereby preparing a for forming a charge generation layer.

The coating liquid for forming a charge generation layer was applied to the undercoat layer with immersion coating. The produced coating film was dried at 100° C. for 10 minutes to form the charge generation layer having a film thickness of 0.16 μm.

Subsequently, 8 parts of a compound (charge transport substance) represented by the following formula (3) and 10 parts of polycarbonate (trade name: Iupilon Z-200, made by Mitsubishi Engineering-Plastics Corporation) were dissolved in 70 parts of monochlorobenzene so as to prepare a coating liquid for forming a charge transport layer.

(3)

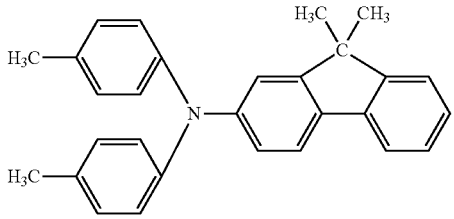

The coating liquid for forming a charge transport layer was applied to the charge generation layer by immersion coating. The produced coating film was dried at 110° C. for 1 hour to form a charge transport layer having a film thickness of 23 μm.

The electrophotographic photosensitive member of Example 2-1 in a cylindrical shape (drum shape) was thus manufactured.

Example 2-2

Except that 5 parts of the exemplary resin (1) in preparation of the coating liquid for forming a charge generation layer in Example 2-1 was replaced with 5 parts of the exemplary resin (8), the electrophotographic photosensitive member of Example 2-2 was made in the same way as in Example 2-1.

Example 2-3

Except that 5 parts of the exemplary resin (1) in preparation of the coating liquid for forming a charge generation layer in Example 2-1 was replaced with 5 parts of the exemplary resin (9), the electrophotographic photosensitive member of Example 2-3 was made in the same way as in Example 2-1.

Example 2-4

Except that the hydroxygallium phthalocyanine crystal in preparation of the coating liquid for forming a charge generation layer in Example 2-1 was replaced with the hydroxygallium phthalocyanine crystal obtained in Example 1-1 without addition of 0.2 parts of the exemplary compound (1), the electrophotographic photosensitive member of Example 2-4 was made in the same way as in Example 2-1.

Example 2-5

Except that 0.2 parts of the exemplary compound (1) in preparation of the coating liquid for forming a charge generation layer in Example 2-1 was replaced with 0.2 parts of the exemplary compound (2), the electrophotographic photosensitive member of Example 2-5 was made in the same way as in Example 2-1.

Example 2-6

Except that 5 parts of the exemplary resin (1) in preparation of the coating liquid for forming a charge generation layer in Example 2-1 was replaced with 5 parts of the exemplary resin (6), the electrophotographic photosensitive member of Example 2-6 was made in the same way as in Example 2-1.

Example 2-7

Except that the hydroxygallium phthalocyanine crystal in preparation of the coating liquid for forming a charge generation layer in Example 2-4 was replaced with the hydroxygallium phthalocyanine crystal obtained in Example 1-2, the electrophotographic photosensitive member of Example 2-7 was made in the same way as in Example 2-4.

Example 2-8

Except that the hydroxygallium phthalocyanine crystal in preparation of the coating liquid for forming a charge generation layer in Example 2-1 was replaced with the hydroxygallium phthalocyanine crystal obtained in Example 1-2, the electrophotographic photosensitive member of Example 2-8 was made in the same way as in Example 2-1.

Example 2-9

Except that the hydroxygallium phthalocyanine crystal in preparation of the coating liquid for forming a charge generation layer in Example 2-4 was replaced with the hydroxygallium phthalocyanine crystal obtained in Example 1-3, the electrophotographic photosensitive member of Example 2-9 was made in the same way as in Example 2-4.

Example 2-10

Except that the hydroxygallium phthalocyanine crystal in preparation of the coating liquid for forming a charge generation layer in Example 2-4 was replaced with the hydroxygallium phthalocyanine crystal obtained in Example 1-4, the electrophotographic photosensitive member of Example 2-10 was made in the same way as in Example 2-4.

Comparative Example 2-1

Except that 5 parts of the exemplary resin (1) in preparation of the coating liquid for forming a charge generation layer in Example 2-1 was replaced with 5 parts of polyvinylbutyral (trade name: S-LEC BX-1, made by Sekisui Chemical Co., Ltd.) without addition of the exemplary compound (1), the electrophotographic photosensitive member of Comparative Example 2-1 was made in the same way as in Example 2-1.

Comparative Example 2-2

Except that 5 parts of the exemplary resin (1) in preparation of the coating liquid for forming a charge generation layer in Example 2-1 was replaced with 5 parts of polyvinylbutyral (trade name: S-LEC BX-1, made by Sekisui Chemical Co., Ltd.), the electrophotographic photosensitive member of Comparative Example 2-2 was made in the same way as in Example 2-1.

Comparative Example 2-3

Except that 5 parts of the exemplary resin (1) in preparation of the coating liquid for forming a charge generation layer in Example 2-5 was replaced with 5 parts of polyvinylbutyral (trade name: S-LEC BX-1, made by Sekisui Chemical Co., Ltd.), the electrophotographic photosensitive member of Comparative Example 2-3 was made in the same way as in Example 2-5.

Comparative Example 2-4

Except that the exemplary compound (1) in preparation of the coating liquid for forming a charge generation layer in Example 2-1 was not added, the electrophotographic photosensitive member of Comparative Example 2-4 was made in the same way as in Example 2-1.

Evaluation of Examples 2-1 to 2-10 and Comparative Examples 2-1 to 2-4

The electrophotographic photosensitive members prepared in Examples 2-1 to 2-10 and Comparative Examples 2-1 to 2-4 were evaluated for ghost images.

A laser beam printer made by Hewlett Packard Japan, Ltd (trade name: Color Laser Jet CP3525dn) was modified to use as an electrophotographic apparatus for evaluation. As a result of modification, a pre-exposing light was unlit and charging conditions and the amount of image exposure were variably controlled. In addition, a manufactured electrophotographic photosensitive member was mounted in a process cartridge for cyan color and attached to the station of the process cartridge for cyan, allowing for operation without mounting of process cartridges for other colors to the laser beam printer main body.

In outputting an image, the process cartridge for cyan color alone was attached to the main body so that a single color image was outputted using cyan toner alone.

The charging conditions and the amount of image exposure were adjusted such that the initial potential was set at −500V for a dark part and −100V for a bright part under a normal temperature and normal humidity environment of 23° C./55% RH. In the measurement of the surface potential of a drum-shaped electrophotographic photosensitive member for potential setting, the cartridge was modified and a potential probe (trade name: model 6000B-8, made by Trek Japan Co., Ltd.) was mounted at the development position. The potential at the center of an electrophotographic photosensitive member in a cylindrical shape was measured with a surface potential meter (trade name: model 344, made by Trek Japan Co., Ltd).

Ghost images were then evaluated under the same conditions. Subsequently, a durability test was performed with 1,000 sheets of paper fed through, and ghost images were evaluated immediately after and 15 hours after the durability test. Evaluation results under a normal temperature and normal humidity environment are described in Table 2.

Subsequently, the electrophotographic photosensitive member was left to stand under a low temperature and low humidity environment of 15° C./10% RH together with the electrophotographic apparatus for evaluation for 3 days so as to evaluate ghost images. A durability test was performed with 1,000 sheets of paper fed through under the same conditions, and ghost images were evaluated immediately after and 15 hours after the durability test. Evaluation results under the low temperature and low humidity environment are also described in Table 2.

In the durability test with paper fed through, an image of character E with a coverage rate of 1% was formed on a plain paper of A4 size with cyan single color.

Ghost images were evaluated as follows.

The evaluation was performed based on the ghost images on 8 sheets in total outputted in succession in the following order: outputting a solid white image on a first sheet, outputting 4 types of ghost charts on respective 4 sheets in total, outputting a solid black image on a sheet, and outputting the 4 types of ghost charts on respective 4 sheets in total once again. The ghost chart includes 4 solid black square images of 25 mm side arranged in parallel at equal intervals in the 30 mm-width region from the starting position of printed images (10 mm from the top edge of paper) as a solid white background. In the region below the 30 mm-width region from the starting position of printed images, 4 types of halftone printing patterns were printed so as to be classified into ranks.

The 4 types of ghost charts are charts arranged in the region below the 30-mm width region from the starting position of printed images, with only difference in halftone pattern. The halftone patterns include the following 4 types.

(1) a printing pattern (laser exposing) with 1 dot and 1 space in lateral* direction.

(2) a printing pattern (laser exposing) with 2 dots and 2 spaces in lateral* direction.

(3) a printing pattern (laser exposing) with 2 dots and 3 spaces in lateral* direction.

(4) a knight jump printing pattern (laser exposing) (a pattern with 2 dots printed in 6 squares in the knight jump direction).

*: The lateral direction means the scanning direction of a laser scanner (the horizontal direction of an outputted sheet).

The ghost images were classified into ranks as follows. It was determined that the effect of the present invention was insufficient in Rank 3 and the higher ranks.

Rank 1: No ghosting was visible in any of the ghost charts.

Rank 2: Ghosting was vaguely visible in a specific ghost chart.

Rank 3: Ghosting was vaguely visible in any of the ghost charts.

Rank 4: Ghosting was visible in a specific ghost chart.

Rank 5: Ghosting was visible in any of the ghost charts.

Rank 6: Ghosting was sharply visible in a specific ghost chart.

TABLE 2

| Evaluation results of ghost image | | | | | | |
|---|---|---|---|---|---|---|
| | Under normal temperature and normal humidity environment | | | Under low temperature and low humidity environment | | |
| | Initial stage Ghosting rank | Immediately after durability test Ghosting rank | 15 hours after durability test Ghosting rank | Initial stage Ghosting rank | Immediately after durability test Ghosting rank | 15 hours after durability test Ghosting rank |
| Example 2-1 | 1 | 2 | 1 | 1 | 2 | 2 |
| Example 2-2 | 1 | 2 | 2 | 2 | 2 | 2 |
| Example 2-3 | 1 | 2 | 2 | 2 | 2 | 2 |
| Example 2-4 | 1 | 1 | 1 | 1 | 2 | 1 |
| Example 2-5 | 1 | 2 | 1 | 1 | 2 | 2 |
| Example 2-6 | 1 | 2 | 1 | 1 | 2 | 2 |
| Example 2-7 | 1 | 1 | 1 | 1 | 1 | 1 |
| Example 2-8 | 1 | 1 | 1 | 1 | 1 | 1 |
| Example 2-9 | 1 | 1 | 1 | 1 | 2 | 2 |
| Example 2-10 | 1 | 2 | 1 | 1 | 2 | 2 |

TABLE 2-continued

| | Evaluation results of ghost image | | | | | |
|---|---|---|---|---|---|---|
| | Under normal temperature and normal humidity environment | | | Under low temperature and low humidity environment | | |
| | Initial stage Ghosting rank | Immediately after durability test Ghosting rank | 15 hours after durability test Ghosting rank | Initial stage Ghosting rank | Immediately after durability test Ghosting rank | 15 hours after durability test Ghosting rank |
| Comparative Example 2-1 | 4 | 5 | 4 | 5 | 6 | 5 |
| Comparative Example 2-2 | 2 | 2 | 2 | 2 | 3 | 2 |
| Comparative Example 2-3 | 2 | 3 | 3 | 2 | 3 | 3 |
| Comparative Example 2-4 | 3 | 4 | 3 | 4 | 5 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-273710, filed on Dec. 14, 2012 which is hereby incorporated by reference herein in its entirety.

What is claimed is:

1. An electrophotographic photosensitive member comprising:

a support; and a photosensitive layer formed on the support;

wherein the photosensitive layer comprises:

(a) a gallium phthalocyanine crystal, (b) an amine compound represented by the following formula (1) which is contained in the gallium phthalocyanine crystal, and (c) a polyvinylacetal resin having a repeating structural unit represented by the following formula (2):

(1)

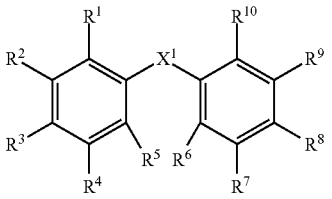

wherein $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group; and at least one of $R^1$ to $R^{10}$ represents an amino group substituted with a substituted or unsubstituted aryl group, an amino group substituted with a substituted or unsubstituted alkyl group, or a substituted or unsubstituted cyclic amino group; and $X^1$ represents a carbonyl group or a dicarbonyl group:

(2)

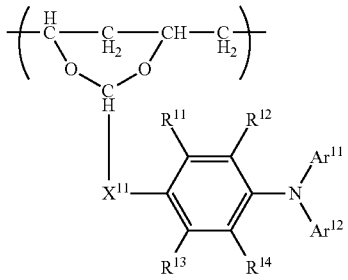

wherein $X^{11}$ represents a substituted or unsubstituted ethylene group, a substituted or unsubstituted propylene group, or a substituted or unsubstituted butylene group;

$R^{11}$, $R^{12}$, $R^{13}$ and $R^{14}$ each independently represent a hydrogen atom, an alkyl group or a methoxy group; and $Ar^{11}$ and $Ar^{12}$ each independently represent a phenyl group having at least one electron donating substituent.

2. The electrophotographic photosensitive member according to claim 1, wherein at least one of the $R^1$ to $R^{10}$ in the formula (1) is an amino group substituted with a substituted or unsubstituted alkyl group.

3. The electrophotographic photosensitive member according to claim 2, wherein the substituted or unsubstituted alkyl group of the amino group substituted with a substituted or unsubstituted alkyl group is an alkyl group substituted with an alkoxy group, an alkyl group substituted with an aryl group, or an unsubstituted alkyl group.

4. The electrophotographic photosensitive member according to claim 2, wherein the amino group substituted with a substituted or unsubstituted alkyl group is a dialkylamino group.

5. The electrophotographic photosensitive member according to claim 4, wherein the dialkylamino group is a dimethylamino group or a diethylamino group.

6. The electrophotographic photosensitive member according to claim 1, wherein at least one of $R^1$ to $R^{10}$ is the substituted or unsubstituted cyclic amino group.

7. The electrophotographic photosensitive member according to claim 6, wherein the substituted or unsubstituted cyclic amino group is a morpholino group or a piperidino group.

8. The electrophotographic photosensitive member according to claim 1, wherein the amine compound is 4,4'-bis(diethylamino)benzophenone.

9. The electrophotographic photosensitive member according to claim 1, wherein the gallium phthalocyanine crystal is a hydroxygallium phthalocyanine crystal.

10. The electrophotographic photosensitive member according to claim 9, wherein the hydroxygallium phthalocyanine crystal is a hydroxygallium phthalocyanine crystal having peaks at Bragg angles 2θ of 7.4°±0.3° and 28.3°±0.3° in X-ray diffraction with CuKα radiation.

11. The electrophotographic photosensitive member according to claim 1, wherein the $X^{11}$ in the formula (2) is an unsubstituted ethylene group.

12. The electrophotographic photosensitive member according to claim 1, wherein each of the $R^{11}$, $R^{12}$, $R^{13}$ and $R^{14}$ in the formula (2) is a hydrogen atom.

13. The electrophotographic photosensitive member according to claim 1, wherein the electron donating substituent in the formula (2) is an alkyl group.

14. The electrophotographic photosensitive member according to claim 1, wherein the photosensitive layer is a laminated photosensitive layer having a charge generation layer and a charge transport layer, the charge generation layer comprising the (a), (b) and (c).

15. A process cartridge detachably attachable to a main body of an electrophotographic apparatus, wherein the process cartridge integrally supports:

an electrophotographic photosensitive member according to claim 1; and at least one unit selected from the group consisting of:

a charging unit for charging the surface of the electrophotographic photosensitive member, a developing unit for developing an electrostatic latent image formed on the surface of the electrophotographic photosensitive member with toner to form a toner image, and a cleaning unit for removing the toner on the surface of the electrophotographic photosensitive member after transfer of the toner image to a transfer material.

16. An electrophotographic apparatus comprising:

an electrophotographic photosensitive member according to claim 1; as well as a charging unit for charging the surface of the electrophotographic photosensitive member, an image exposure unit for irradiating the charged surface of the electrophotographic photosensitive member with image exposing light to form an electrostatic latent image, a developing unit for developing the electrostatic latent image formed on the surface of the electrophotographic photosensitive member with toner to form a toner image, and a transferring unit for transferring the toner image formed on the surface of the electrophotographic photosensitive member to a transfer material.

* * * * *